US009240106B2

(12) United States Patent
Iizuka

(10) Patent No.: US 9,240,106 B2
(45) Date of Patent: Jan. 19, 2016

(54) AUTOMATIC TRANSACTION APPARATUS

(75) Inventor: Mamoru Iizuka, Gumma (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 94 days.

(21) Appl. No.: 13/806,836

(22) PCT Filed: May 9, 2011

(86) PCT No.: PCT/JP2011/060653

§ 371 (c)(1),
(2), (4) Date: Mar. 1, 2013

(87) PCT Pub. No.: WO2012/002036

PCT Pub. Date: Jan. 5, 2012

(65) Prior Publication Data

US 2013/0153361 A1 Jun. 20, 2013

(30) Foreign Application Priority Data

Jun. 28, 2010 (JP) ..... 2010-146204

(51) Int. Cl.
*G07F 7/04* (2006.01)
*G07F 19/00* (2006.01)
*G07D 11/00* (2006.01)

(52) U.S. Cl.
CPC ..... *G07F 19/20* (2013.01); *G07D 11/0006* (2013.01); *G07D 11/0012* (2013.01); *G07D 11/0081* (2013.01); *Y10S 902/12* (2013.01)

(58) Field of Classification Search
CPC . G07D 11/0081; G07D 11/0084; G07D 7/00; G07D 7/12; G07D 7/20; G07D 11/0018; G07D 11/00; G07D 11/0003; G07D 11/0006; G07D 11/0009; G07D 11/0012; G07D 11/0015; G07D 11/0021; G07D 11/0024; G07D 11/0027; G07D 11/003; G07D 11/0033; G07D 11/0087; G07D 13/00; G07D 11/009; G07D 11/0093; G07D 11/0096; G07D 2207/00; G07D 2211/00; G07F 7/04; G07F 19/20; G07F 19/201; G07F 19/00; G07F 19/202; G07F 19/203; G07F 19/204; G07F 19/205; G07F 19/2055; B65H 2701/1912; B65H 29/40; B65H 2301/4212; B65H 2511/514; G06K 13/12; G06Q 20/1085; G06Q 20/042
USPC ..... 194/206, 207; 209/534; 382/135; 347/84; 235/379; 902/8–17
See application file for complete search history.

(56) References Cited

U.S. PATENT DOCUMENTS 4,905,840 A * 3/1990 Yuge et al. ..... 209/534
8,087,656 B2 * 1/2012 Fujita et al. ..... 271/3.01

(Continued)

FOREIGN PATENT DOCUMENTS

CN 101645185 A 2/2010
EP 0 967 581 A2 12/1999

(Continued)

OTHER PUBLICATIONS

Chinese Office Action dated Jul. 15, 2014 with English translation.

(Continued)

*Primary Examiner* — Jeffrey Shapiro
(74) *Attorney, Agent, or Firm* — Rabin & Berdo, P.C.

(57) ABSTRACT

Disclosed is an automatic transaction apparatus comprising an upper unit and a lower unit, wherein a means is provided for reducing the cost of manufacturing the upper unit. An automatic transaction apparatus comprises: an upper unit (2*a*) provided with a bill deposit/withdrawal part (3) and a sorting part (4); and a lower unit (2*b*) comprising denomination-specific cassettes (13) and a reject storage part (15). The automatic transaction apparatus is provided with: an upper conveyance path (7) which conveys bills to the parts in the upper unit (2*a*); and a lower conveyance path (10) which is connected to the upper conveyance path (7) and is disposed in the lower unit (2*b*), and which branches midway and conveys bills to the denomination-specific cassettes (13) or the reject storage part (15).

10 Claims, 4 Drawing Sheets

(56) References Cited

U.S. PATENT DOCUMENTS

| | | | | |
|---|---|---|---|---|
| 2002/0060421 | A1* | 5/2002 | Kako et al. | 271/259 |
| 2004/0101328 | A1* | 5/2004 | Kimura et al. | 399/111 |
| 2004/0251110 | A1* | 12/2004 | Jenrick et al. | 194/207 |
| 2005/0189266 | A1* | 9/2005 | Fujita et al. | 209/534 |
| 2006/0076729 | A1* | 4/2006 | Kozaki et al. | 271/9.11 |
| 2007/0187486 | A1* | 8/2007 | Nomiyama et al. | 235/379 |
| 2008/0150216 | A1* | 6/2008 | Ichikawa et al. | 271/3.01 |
| 2008/0150224 | A1* | 6/2008 | Shimizu et al. | 271/263 |
| 2009/0057093 | A1* | 3/2009 | Iwami et al. | 194/206 |
| 2009/0107799 | A1* | 4/2009 | Kadowaki et al. | 194/206 |
| 2009/0134567 | A1* | 5/2009 | Taniyama et al. | 271/225 |
| 2009/0319080 | A1* | 12/2009 | Utsumi et al. | 700/231 |
| 2011/0046774 | A1* | 2/2011 | Demmeler | 700/223 |

FOREIGN PATENT DOCUMENTS

| | | | |
|---|---|---|---|
| JP | H0212592 | A | 1/1990 |
| JP | 2-252096 | A | 10/1990 |
| JP | H0458390 | A | 2/1992 |
| JP | 2007-026014 | A | 2/2007 |
| JP | 2010-039831 | A | 2/2010 |
| JP | 2010-108160 | A | 5/2010 |

OTHER PUBLICATIONS

Japanese Office Action issued on Jan. 14, 2014 with English translation.

Russian Office Action with English translation.

* cited by examiner

AUTOMATIC TRANSACTION APPARATUS

TECHNICAL FIELD

The present invention relates to an automatic transaction apparatus that is equipped with a bill storage section, and that stores inserted bills in the bill storage section per denomination.

BACKGROUND ART

In a conventional automatic transaction apparatus, a bill, that has been inserted in a bill deposit/withdrawal section during a deposit transaction, is conveyed and the authenticity thereof is discriminated at a discrimination section, and a bill, that is a legitimate bill from these discrimination results, is stored once in a temporary holding section, and, after the transaction is settled, the bill that is stored in the temporary holding section is again discriminated, and, in accordance with the denomination thereof, is conveyed to and stored in a bill storage section that is structured from plural cassettes (see, for example, Japanese Patent Application Laid-Open No. 2010-108160 (paragraph [0008] through paragraph [0015]).

Generally, an automatic transaction apparatus is structured so as to be divided into an upper unit and a lower unit, and the aforementioned bill deposit/withdrawal section, discriminating section, and temporary holding section are provided within the upper unit, and the bill storage section is provided within the lower unit. At the upper unit, there is provided a conveying path that conveys bills to the respective sections and has a branching portion for conveying bills to the respective cassettes of the bill storage section of the lower unit. Accordingly, the conveying path of bills is branched-off at the branching portion that is on the midst of the conveying path of the upper unit, and the bills are conveyed to the respective cassettes of the lower unit.

DISCLOSURE OF INVENTION

Technical Problem

However, in the above-described conventional art, because the branching portion is provided at the conveying path of the upper unit, this conveying path must be made to be a structure that accords with the structure of the bill storage section of the lower unit. Namely, because the conveying path of the upper unit has a structure that is branched into a number of paths corresponding to the number of cassettes, the structure of the conveying path at the upper unit must be determined in accordance with the number of cassettes at the lower unit. There is the problem that the structure of the conveying path becomes complex, such as, the greater the number of cassettes, the longer the conveying path of the upper unit must be made to be, and the like, and the manufacturing cost of the upper unit increases.

An object of the present invention is to provide means for solving the above-described problematic point.

Solution to Problem

In order to solve the above-described problem, the present invention is an automatic transaction apparatus comprising: an upper unit having a deposit/withdrawal section into which bills are inserted and that discharges bills, and a discriminating section that discriminates bills; and a lower unit having a plurality of denomination-specific cassettes that store bills per denomination, and a reject depository that stores bills, that are not objects of withdrawal among bills that are drawn-out from the denomination-specific cassettes in a withdrawal process, and foreign matter, that a customer has left inserted in the deposit/withdrawal section in a deposit process and has forgotten to remove, wherein an upper conveying path, that conveys bills to respective sections within the upper unit, and a lower conveying path, that is connected to the upper conveying path and is disposed within the lower unit and branches-off midway therealong and conveys bills to the denomination-specific cassettes or the reject depository, are provided.

Advantageous Effects of Invention

Due thereto, the present invention has the excellent effect that, by providing the conveying path, that is branched-off in order to convey bills to the denomination-specific cassettes and the reject depository, at the lower unit side, the structure of the upper conveying path within the upper unit is determined regardless of the structure of the lower unit, and therefore, the manufacturing cost of the upper unit can be reduced.

BEST MODES FOR CARRYING OUT THE INVENTION

Embodiments of the automatic transaction apparatus in accordance with the present invention are described hereinafter with reference to the drawings.

Embodiment 1

Figure 1:
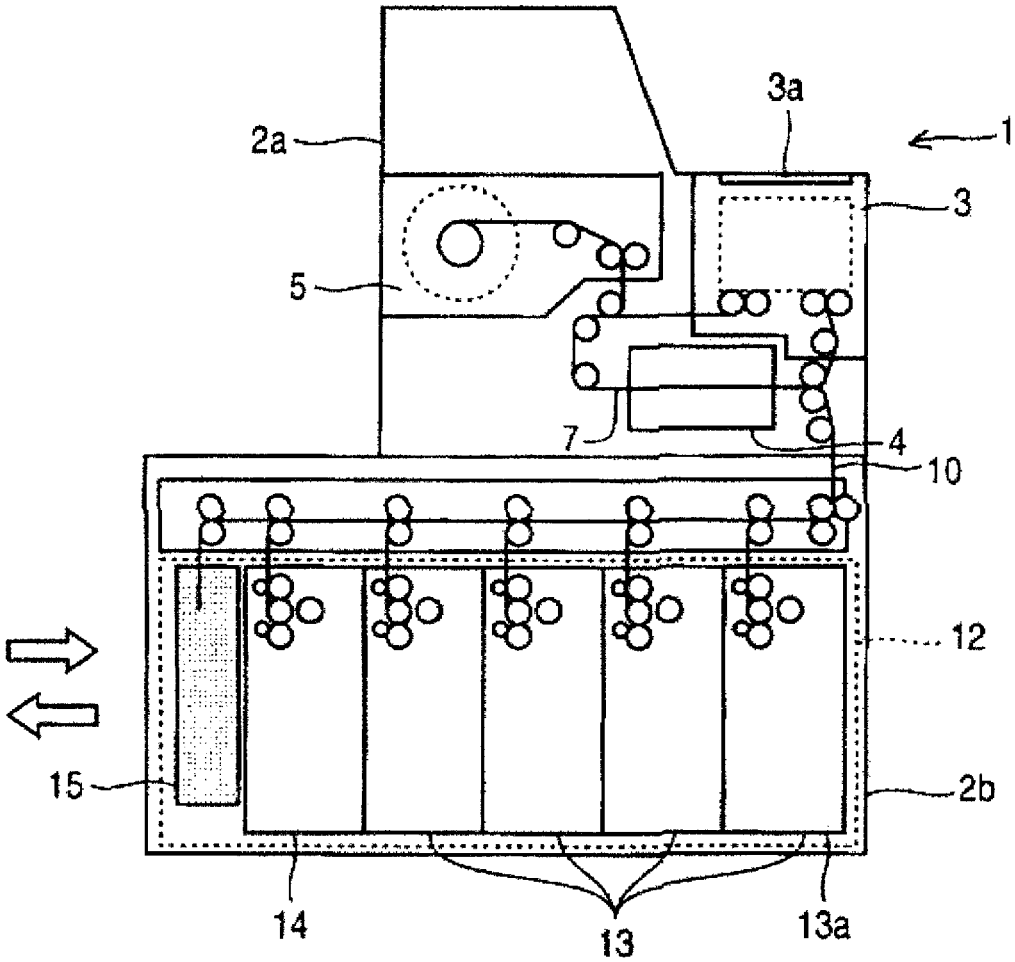
FIG. 1 is an explanatory drawing showing an automatic transaction apparatus of embodiment 1.

FIG. 1 is an explanatory drawing showing an automatic transaction apparatus of embodiment 1.

In FIG. 1, 1 is an automatic transaction apparatus having a bill separating/stacking mechanism, and is structured by two units that are an upper unit 2*a* and a lower unit 2*b*, and is set in a branch of a financial institution such as a bank or the like and automatically carries out transactions with customers.

Further, at the customer interface surface of the front surface thereof, the automatic transaction apparatus 1 is provided with a display screen and a touch panel, a card insertion/return opening into which a cash card of a customer is inserted, a bankbook insertion/return opening into which a bankbook is inserted, a bill deposit/withdrawal opening into which bills serving as cash are inserted, and the like.

The upper unit 2*a* has a bill deposit/withdrawal section 3, a discriminating section 4, a temporary holding section 5, an upper conveying path 7 for conveying bills to the respective sections, and the like.

The lower unit 2*b* has a lower conveying path 10 that is connected to the upper conveying path 7 of the upper unit 2*a*, a bill storage section 12, and the like.

The bill deposit/withdrawal section 3 is provided with a shutter 3*a* that closes the bill deposit/withdrawal opening provided at the customer interface section. Bills, which are inserted into the bill deposit/withdrawal opening at which the shutter 3*a* is open, are received in a standing state.

The discriminating section 4 discriminates the authenticity, the damaged/undamaged state, the denomination and the like of bills.

The temporary holding section 5 temporarily stores the bills, that are discriminated as being legitimate bills at the discriminating section 4, until the transaction is settled.

At the upper conveying path 7, plural rollers are disposed along a conveying path of the bills. Due to the respective rollers being rotated by an unillustrated motor, a bill that has been inserted into the bill deposit/withdrawal section 3 is conveyed to the discriminating section 4, and the bill is conveyed from the discriminating section 4 to the temporary holding section 5 or the bill deposit/withdrawal section 3.

Moreover, the upper conveying path 7 is connected to the lower conveying path 10 of the lower unit 2*b* that is described later, and bills are transferred to the lower conveying path 10 thereby.

Further, at the upper conveying path 7, the interval between the rollers on the conveying paths, that connect the bill deposit/withdrawal section 3 and the discriminating section 4 and the temporary holding section 5, is made to be an interval that can reliably convey slips that are shorter than the lengths of bills that are handled, such as receipts, tickets, slips that are folded in half, or the like that a customer has mistakenly inserted (hereinafter also called "media", "short slips", or "foreign matter"), and is an interval that is narrower than the roller interval for conveying usual bills.

Moreover, also the interval between rollers that are on the conveying paths from the portion, that is connected with the upper conveying path 7, of the lower conveying path 10 of the lower unit 2*b* to a reject depository 15, or the portion, that is connected with the upper conveying path 7, of the lower conveying path 10 of the lower unit 2*b* to denomination-specific cassettes 13*a*, is a roller pitch that is similar to that on the conveying paths that connect the bill deposit/withdrawal section 3 and the discriminating section 4 and the temporary holding section 5 of the above-described upper conveying path 7.

At the lower conveying path 10, the other end portion, that is branched-off toward the respective cassettes that are described later of the bill storage section 12, extends from the one end portion that is connected to the upper conveying path 7, and the lower conveying path 10 is a path that conveys bills to the bill storage section 12.

The bill storage section 12 is structured by the plural denomination-specific cassettes 13 that store bills per denomination, and a replenish/recovery cassette 14 that stores bills that are objects of recovery that cannot fit into the denomination-specific cassettes 13 and bills to be replenished to the denomination-specific cassettes 13, and the reject depository 15 being lined-up.

The reject depository 15 collects, among the bills that are drawn-out from the denomination-specific cassettes 13 in a withdrawal transaction or the like, the bills that have been discriminated as being reject bills at the discriminating section, and media left behind by customers that are media that are objects of return such as receipts and tickets and the like that a customer has mistakenly inserted during a deposit transaction.

The bill storage section 12 is mounted so as to be movable in the directions shown by the arrows in FIG. 1 by, for example, a slide rail, and due thereto, a door, that is provided at the housing of the lower unit 2*b*, can be opened and the bill storage section 12 can be pulled-out to the exterior.

Note that the door that is provided at the housing of the lower unit 2*b* is made to be a door provided at the side opposite the side at which the aforementioned customer interface surface is provided, i.e., provided at the reverse surface side.

Further, in the bill storage section 12, the denomination-specific cassettes 13, the replenish/recovery cassette 14, and then the reject depository 15 are disposed in order from the upstream side in the conveying direction of a bill in a deposit transaction, i.e., the reject depository 15 is disposed furthest toward the reverse surface side.

Further, the above-described lower conveying path 10 is connected to the bill storage section 12 so as to be rotatable via an unillustrated fulcrum, and extends so as to pass above the bill storage section 12.

Therefore, when the bill storage section 12 is pulled-out to the exterior such as at the time of a maintenance inspection or the like of the automatic transaction apparatus 1, the lower conveying path 10 also is pulled-out, and due to the lower conveying path 10 being rotated around the unillustrated fulcrum in the pulled-out state, the lower conveying path 10 is oriented so as to be withdrawn from the upper side of the bill storage section 12.

Figure 2:
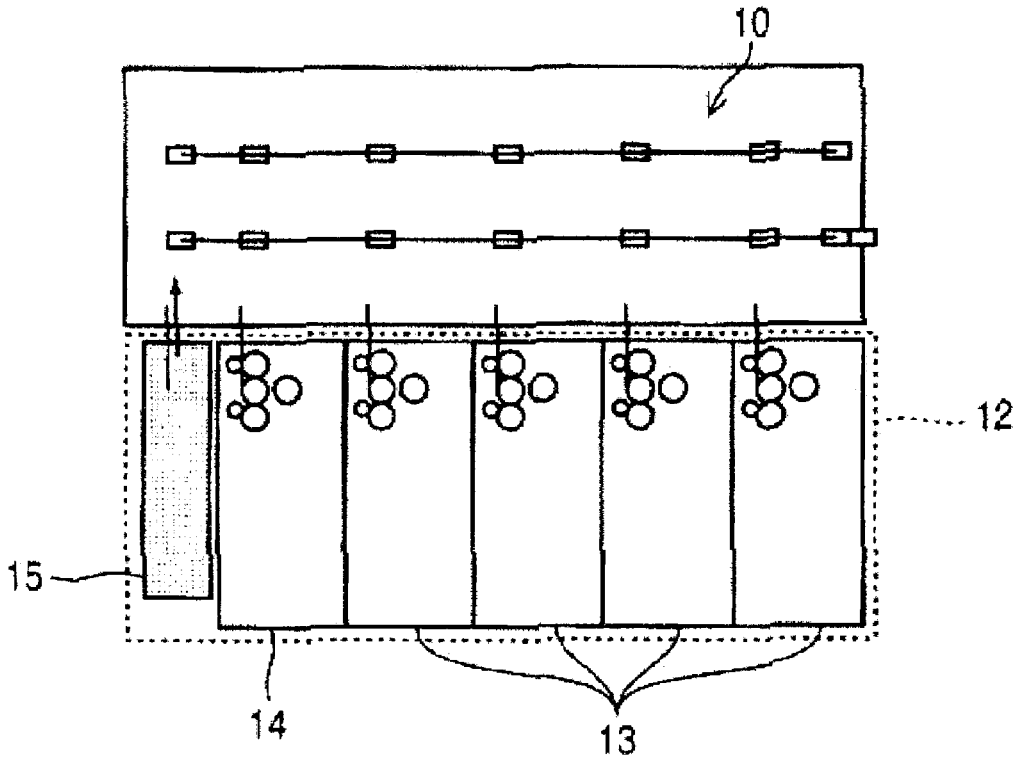
FIG. 2 is an explanatory drawing showing a state in which a lower conveying path of embodiment 1 has been rotated.

Here, FIG. 2 is an explanatory drawing that shows the state in which the lower conveying path of embodiment 1 has been rotated.

By rotating the lower conveying path 10 and placing it in a state of opening the upper side of the bill storage section 12, the reject depository 15 can be pulled-up in the direction of the arrow shown in FIG. 2, i.e., upward, and it is possible to remove only the reject depository 15.

Operation of the above-described structure is described.

In the case of carrying out a deposit transaction, the shutter 3*a* of the bill deposit/withdrawal section 3 is opened.

When insertion of a bill into the bill deposit/withdrawal section 3 is confirmed by an unillustrated sensor, the shutter is closed, and the bill within the bill deposit/withdrawal section 3 is drawn-out and conveyed to the discriminating section 4.

Next, discrimination of the bill conveyed to the discriminating section 4 is carried out. A bill, for which the results of discrimination are that the bill is a legitimate bill, is conveyed to and stored in the temporary holding section 5. A bill whose denomination cannot be discriminated is conveyed to the bill deposit/withdrawal section 3 as a bill that is an object of return, and is returned to the customer.

Note that the control section of the automatic transaction apparatus calculates the total amount of the bills that were judged as being legitimate bills at the discriminating section 4 and were conveyed to the temporary holding section 5, and, after all of the bills have been discriminated, the control section displays, on the display screen of the customer interface surface, the calculated total amount and a screen that asks whether or not the deposit transaction is to be carried out.

When the customer operates an unillustrated touch panel of the customer interface surface and carries out input of the purport that the deposit transaction is to be carried out, the automatic transaction apparatus 1 conveys the bills, that are stored in the temporary holding section 5, to the discriminating section 4 again and discriminates the denominations, and, in accordance with the denominations thereof, stores the bills in the denomination-specific cassettes 13.

At this time, the bills that are conveyed from the upper conveying path 7 toward the lower conveying path 10 all pass through a common path and reach the lower conveying path 10, and, in the midst of being conveyed by the lower conveying path 10, are forked-off and conveyed to the denomination-specific cassettes 13 that correspond to the respective denominations.

As described above, in the present embodiment, in an automatic transaction apparatus that is divided into an upper unit and a lower unit, the midst of the lower conveying path is branched-off in order to convey bills to the denomination-specific cassettes and the replenish/recovery cassette and the reject depository. Due thereto, the structure of the upper conveying path can be determined regardless of the structure of the lower unit, and the automatic transaction apparatus can be structured by connecting the upper unit to lower units of various structures. Therefore, there are the effects that the versatility of the upper unit improves, and further, the manufacturing cost of the upper unit can be reduced.

Further, by structuring the bill storage section such that the reject depository is positioned the furthest downstream in the direction of pulling-out the bill storage section from the lower unit, the efficiency of the maintenance work of the automatic transaction apparatus improves and the convenience improves for a maintenance worker who carries out maintenance work of the automatic transaction apparatus at which the frequency of usage of the reject depository is high. Moreover, the interval between the rollers on the conveying path from the customer interface opening to the shortest cassette (the denomination-specific cassettes 13*a*) is made to be an interval that can reliably convey slips that are shorter than the lengths of bills that are handled, such as receipts, tickets, slips that are folded in half, or the like that a customer has mistakenly inserted, and is made to be an interval that is narrower than the roller interval for conveying usual bills. Due thereto, short slips, that are discriminated as having unclear denominations or the like at the above-described discriminating section 4 and that are stacked in the bill deposit/withdrawal section 3, are returned to the customer by opening the shutter 3*a*. Whether the customer takes such a slip out or not is observed by an unillustrated sensor that is provided within the bill deposit/withdrawal section 3, and, if such a slip is not taken-out within a predetermined time, the slip is drawn-out to the upper conveying path 7 as an object that the customer has left behind, and can be conveyed from the upper conveying path 7 via the lower conveying path 10 to the denomination-specific cassettes 13*a* and stored therein, and the denomination-specific cassettes 13*a* can be changed so as to be used as a short slip storage depository.

Embodiment 2

In contrast with above-described embodiment 1, the present embodiment is an embodiment from which effects can be anticipated by application to the automatic transaction apparatus 1 that is a front-surface maintenance type in which the bill storage section 12 is pulled-out toward the front side with respect to the bill deposit/withdrawal section 3. In the present embodiment, there is made to be a structure in which a maintenance worker, who is standing in front of the automatic transaction apparatus 1, pulls the bill storage section 12 out toward the front side.

Figure 3:
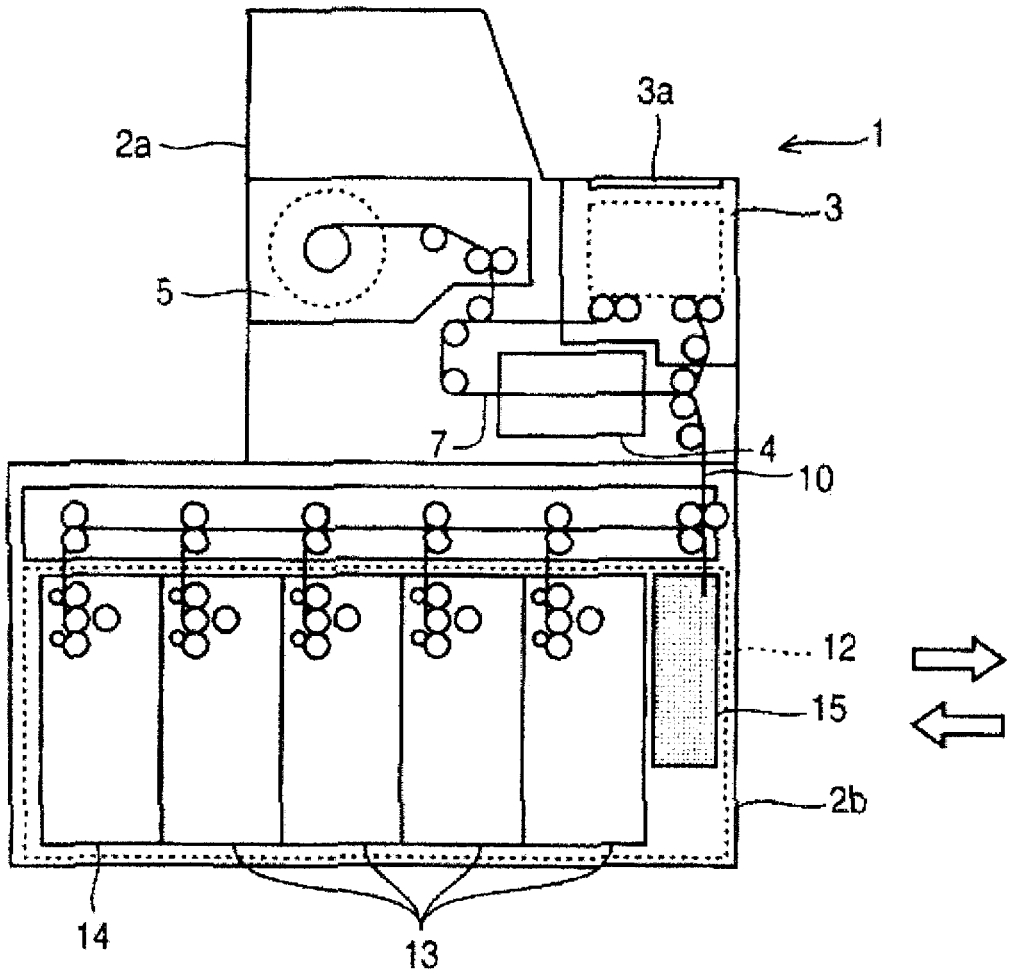
FIG. 3 is an explanatory drawing showing an automatic transaction apparatus of embodiment 2.

Here, FIG. 3 is an explanatory drawing that shows the automatic transaction apparatus of embodiment 2.

In the present embodiment, the lower unit 2*b* is pulled-out toward the front surface side, i.e., the near side, of the apparatus. Therefore, as shown in FIG. 3, the reject depository 15 of the bill storage section 12 is disposed furthest toward the near side, in the pull-out direction of the bill storage section 12, so that it is easy for a maintenance worker to remove the reject depository 15.

Further, at the upper conveying path 7, the interval between the rollers on the conveying paths, that connect the bill deposit/withdrawal section 3 and the discriminating section 4 and the temporary holding section 5, is made to be an interval that can reliably convey slips (media) that are shorter than the lengths of bills that are handled, such as receipts, tickets, slips that are folded in half, or the like that a customer has mistakenly inserted, and is made to be an interval that is narrower than the roller interval for conveying usual bills.

Moreover, also the interval between rollers that are on the conveying path from the portion, that is connected with the upper conveying path 7, of the lower conveying path 10 of the lower unit 2*b* to the reject depository 15, is a roller pitch that is similar to that on the conveying paths that connect the bill deposit/withdrawal section 3 and the discriminating section 4 and the temporary holding section 5 of the above-described upper conveying path 7.

Figure 4:
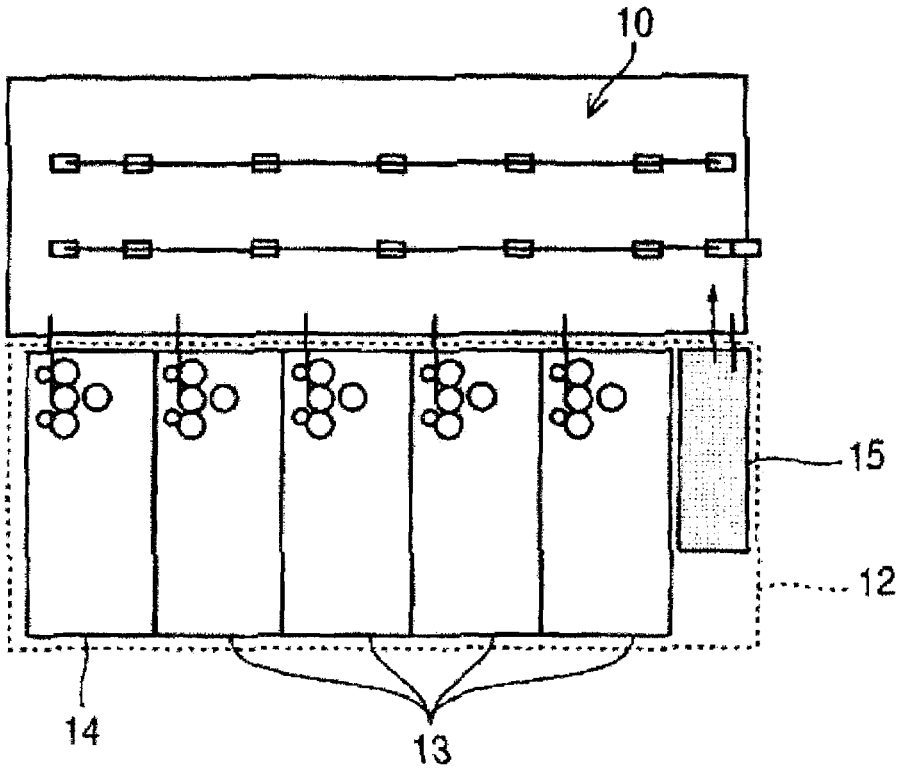
FIG. 4 is an explanatory drawing showing a state in which a lower conveying path of embodiment 2 has been rotated.

Here, FIG. 4 is an explanatory drawing that shows a state in which the lower conveying path 10 of embodiment 2 is rotated.

In the same way as embodiment 1, the lower conveying path 10 of the automatic transaction apparatus 1 of the present embodiment as well is connected to the bill storage section 12 so as to be rotatable via an unillustrated fulcrum, and extends so as to pass above the bill storage section 12. At the time of pulling-out the bill storage section 12, the lower conveying path 10 also is pulled-out, and due to the lower conveying path 10 being rotated around the unillustrated fulcrum in the pulled-out state, the lower conveying path 10 is oriented so as to be withdrawn from the upper side of the bill storage section 12 as shown in FIG. 4.

Moreover, due to the reject depository 15 being pulled-up in the direction of the arrow shown in FIG. 4, i.e., upward, it is possible to remove only the reject depository 15.

Operation of the above-described structure is described.

At the automatic transaction apparatus 1 of the present embodiment, when, in a deposit transaction, a customer mistakenly inserts a short slip that is shorter than a bill, such as a slip that is that are folded in half or a ticket or the like, into the bill deposit/withdrawal section 3 together with bills, the bills that are inserted in the bill deposit/withdrawal section 3 are separated one-by-one and are conveyed to the discriminating section 4.

Then, the short slip and bills that are discriminated as counterfeit bills at the discriminating section 4 are conveyed to and stacked in the bill deposit/withdrawal section 3 by the upper conveying path 7.

On the other hand, bills, that are discriminated as being legitimate bills at the discriminating section 4, are conveyed to and stored in the temporary holding section 5. At this time, the unillustrated control section of the automatic transaction apparatus 1 computes the total amount of the bills that were conveyed to the temporary holding section 5, and, after all of the bills have been discriminated, the control section displays, on the display screen of the customer interface surface, the computed total amount and a screen that asks whether or not the deposit transaction is to be carried out.

When the customer operates an unillustrated touch panel of the customer interface surface and carries out input of the purport that the deposit transaction is to be carried out, the automatic transaction apparatus 1 conveys the bills, that are stored in the temporary holding section 5, to the discriminating section 4 again and discriminates the denominations, and, in accordance with the denominations thereof, stores the bills in the denomination-specific cassettes 13.

The bills that are conveyed from the upper conveying path 7 toward the lower conveying path 10 all pass through a common path and reach the lower conveying path 10, and, in the midst of being conveyed by the lower conveying path 10, are forked-off and conveyed to the denomination-specific cassettes 13 that correspond to the respective denominations.

Note that short slips, that are discriminated as having unclear denominations or the like at the above-described discriminating section 4 and that are stacked in the bill deposit/withdrawal section 3, are returned to the customer by opening the shutter 3*a*. Whether the customer takes such a slip out or not is observed by an unillustrated sensor that is provided within the bill deposit/withdrawal section 3, and, if such a slip is not taken-out within a predetermined time, the slip is drawn-out to the upper conveying path 7 as an object that the customer has left behind, and is conveyed from the upper conveying path 7 via the lower conveying path 10 to the reject depository 15 and stored therein.

As described above, in the present embodiment, in addition to the effects of above-described embodiment 1, the remaining of foreign matter in the midst of the respective conveying paths can be prevented by narrowly arranging the interval between the rollers of the upper conveying path and the lower conveying path so that foreign matter that is shorter than the lengths of bills, such as tickets or the like that a customer has forgotten to take-out from the bill deposit/withdrawal section, can be reliably conveyed to the reject depository.

Further, by structuring the bill storage section such that the reject depository is disposed at the furthest upstream side in the conveying direction of bills during a deposit transaction, the distance from the bill deposit/withdrawal section to the reject depository, i.e., the range of the place where the roller interval of the upper conveying path and the lower conveying path is arranged narrowly, is shortened. Therefore, an increase in costs due to the number of rollers being increased too much can be suppressed.

The invention claimed is:

1. An automatic transaction apparatus comprising:

an upper unit having a bill deposit/withdrawal section into which bills are inserted and that discharges bills, and a discriminating section that discriminates between bills; and a lower unit having a plurality of denomination-specific cassettes that store bills per denomination, and a reject depository that stores bills, which are not objects of withdrawal among bills that are drawn-out from the denomination-specific cassettes in a withdrawal process;

wherein the denomination-specific cassettes and the reject depository are lined-up in a front-rear direction of the automatic transaction apparatus, thereby configuring a bill storage section including the denomination-specific cassettes and the reject depository;

wherein an upper conveying path, which conveys bills to respective sections within the upper unit, and a lower conveying portion, which is connected to the upper conveying path and is disposed over the denomination-specific cassettes and the reject depository within the lower unit and branches off midway therealong and conveys bills to the denomination-specific cassettes or the reject depository, are provided;

wherein bills that are conveyed from the upper conveying path toward the lower conveying portion all pass through a common path and reach the lower conveying portion;

wherein the bill storage section is mounted so as to be able to be pulled-out from an interior to an exterior of the lower unit in the front-rear direction of the automatic transaction apparatus; and wherein the lower conveying portion is connected to the bill storage section so as to be movable to open an upper side of the bill storage section and so that the lower conveying portion and the bill storage section are simultaneously pullable to be pulled-out, and in a state of opening the upper side of the bill storage section when the bill storage section is pulled-out, the reject depository is pullable upward.

2. The automatic transaction apparatus of claim 1, wherein the reject depository is disposed furthest forward with respect to a direction of being pulled-out from the lower unit among the denomination-specific cassettes and the reject depository.

3. The automatic transaction apparatus of claim 1, wherein, by positioning the bill deposit/withdrawal section, the common path, and the reject depository at an apparatus front surface side, and configuring the automatic transaction apparatus such that the denomination-specific cassettes and the reject depository are configured to be pulled-out from the interior to the exterior of the lower unit in a front surface direction of the apparatus, a conveying distance of bills from the bill deposit/withdrawal section to the reject depository is shorter than a conveying distance of bills from the bill deposit/withdrawal section to the denomination-specific cassettes.

4. The automatic transaction apparatus of claim 3, wherein the upper conveying path and the lower conveying portion are structured by a plurality of rollers, which are for conveying bills along the upper conveying path and the lower conveying portion, being lined-up, and a roller interval on a conveying path, which is from the bill deposit/withdrawal section of the upper conveying path to the common path, and a roller interval on a conveying path, which is from the common path to the reject depository, are shorter than a roller interval for conveying a normal bill.

5. The automatic transaction apparatus of claim 1, wherein the upper conveying path and the lower conveying portion are structured by a plurality of rollers, which are for conveying bills along the upper conveying path and the lower conveying portion, being lined-up, a shortest denomination-specific cassette of the denomination-specific cassettes is at a shortest position from the bill deposit/withdrawal section among the denomination-specific cassettes, a roller interval on a conveying path, which is from the bill deposit/withdrawal section of the upper conveying path to the common path, and a roller interval on a conveying path, which is from the common path to the shortest denomination-specific cassette, are shorter than a roller interval for conveying a normal bill, and a medium, which a customer has forgotten to remove from the bill deposit/withdrawal section, is conveyed to the shortest denomination-specific cassette and the shortest denomination-specific cassette is changed to a medium storage section that stores media that customers have forgotten to remove.

6. The automatic transaction apparatus of claim 2, wherein, by positioning the bill deposit/withdrawal section, the common path, and the reject depository at an apparatus front surface side, and configuring the automatic transaction apparatus such that the denomination-specific cassettes and the reject depository are configured to be pulled-out from the interior to the exterior of the lower unit in a front surface direction of the apparatus, a conveying distance of bills from the bill deposit/withdrawal section to the reject depository is shorter than a conveying distance of bills from the bill deposit/withdrawal section to the denomination-specific cassettes.

7. The automatic transaction apparatus of claim 6, wherein the upper conveying path and the lower conveying portion are structured by a plurality of rollers, which are for conveying bills along the upper conveying path and the lower conveying portion, being lined-up, and a roller interval on a conveying path, which is from the bill deposit/withdrawal section of the upper conveying path to the common path, and a roller interval on a conveying path, which is from the common path to the reject depository, are shorter than a roller interval for conveying a normal bill.

8. The automatic transaction apparatus of claim 2, wherein the upper conveying path and the lower conveying portion are structured by a plurality of rollers, which are for conveying bills along the upper conveying path and the lower conveying portion, being lined-up, a shortest denomination-specific cassette of the denomination-specific cassettes is at a shortest position from the bill deposit/withdrawal section among the denomination-specific cassettes, a roller interval on a conveying path, which is from the bill deposit/withdrawal section of the upper conveying path to the common path, and a roller interval on a conveying path, which is from the common path to the shortest denomination-specific cassette, are shorter than a roller interval for conveying a normal bill, and a medium, which a customer has forgotten to remove from the bill deposit/withdrawal section, is conveyed to the shortest denomination-specific cassette, and the shortest denomination-specific cassette is changed to a medium storage section that stores media that customers have forgotten to remove.

9. The automatic transaction apparatus of claim 1, wherein the lower conveying portion is connected to the bill storage section so that in every instance when the bill storage section is pulled-out, the lower conveying portion is also simultaneously pulled-out.

10. The automatic transaction apparatus of claim 1, further comprising a fulcrum, the lower conveying portion rotating about the fulcrum when the lower conveying portion is pulled-out with the bill storage section.

* * * * *